US008082595B2

(12) United States Patent
Nordstrom

(10) Patent No.: US 8,082,595 B2
(45) Date of Patent: Dec. 27, 2011

(54) ARTICLE OF SWIMWEAR WITH RESILIENT SEAL

(75) Inventor: Matthew D. Nordstrom, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1076 days.

(21) Appl. No.: 10/797,589

(22) Filed: Mar. 10, 2004

(65) Prior Publication Data

US 2005/0198722 A1 Sep. 15, 2005

(51) Int. Cl.
*A41D 5/00* (2006.01)

(52) U.S. Cl. ..... 2/67

(58) Field of Classification Search ..... 2/67, 69, 2/243.1, 170–177
See application file for complete search history.

(56) References Cited

U.S. PATENT DOCUMENTS

| | | | | |
|---|---|---|---|---|
| 1,771,178 | A * | 7/1930 | Howland | 2/68 |
| 3,026,225 | A | 3/1962 | Ostby | 154/50 |
| 3,852,823 | A * | 12/1974 | Jones | 2/68 |
| 4,179,754 | A | 12/1979 | Denu | 2/67 |
| 4,365,351 | A * | 12/1982 | Doerschuk et al. | 2/2.15 |
| 4,535,477 | A | 8/1985 | Musto et al. | |
| 4,604,152 | A | 8/1986 | Liukko | 156/93 |
| 4,915,046 | A | 4/1990 | Meistrell | 112/419 |
| 4,999,845 | A * | 3/1991 | Jenks et al. | 2/2.16 |
| 5,003,902 | A | 4/1991 | Benstock et al. | 112/418 |
| 5,809,567 | A | 9/1998 | Jacobs et al. | 2/1 |
| 5,996,120 | A * | 12/1999 | Balit | 2/67 |
| 6,079,343 | A | 6/2000 | Wong | 112/475.09 |
| 6,088,832 | A * | 7/2000 | Newman | 2/67 |
| 6,112,327 | A * | 9/2000 | Shaffer | 2/67 |
| 6,185,741 | B1 * | 2/2001 | Kehoe | 2/67 |
| 6,375,770 | B1 | 4/2002 | Meltzer et al. | 156/73.4 |
| 6,438,755 | B1 | 8/2002 | MacDonald et al. | 2/69 |
| 6,446,264 | B2 * | 9/2002 | Fairhurst et al. | 2/69 |
| 6,484,319 | B1 * | 11/2002 | Fusco et al. | 2/67 |
| 6,546,560 | B2 | 4/2003 | Fusco et al. | 2/67 |
| 6,622,312 | B2 | 9/2003 | Rabinowicz | 2/401 |
| 6,647,550 | B1 | 11/2003 | Matsuzaki et al. | 2/67 |
| 2002/0152531 | A1 | 10/2002 | Fusco et al. | |
| 2003/0019373 | A1 | 1/2003 | Jordan | |

FOREIGN PATENT DOCUMENTS

| | | |
|---|---|---|
| DE | 2607613 | 9/1977 |
| EP | 0 411 351 A1 | 2/1991 |
| EP | 1330963 A1 | 7/2003 |
| EP | 1 211 956 B1 | 1/2004 |
| FR | 2867356 A1 | 9/2005 |
| GB | 1518065 A | 7/1978 |
| JP | 01314710 | 12/1989 |
| JP | 5-085473 | 4/1993 |
| JP | 8-058686 | 3/1996 |
| JP | 2001032104 | 2/2001 |
| WO | 9801337 | 1/1998 |

OTHER PUBLICATIONS

Article from www.wblivesurf.com "Rip Curl Unveils the World's First Stitchless Boardshort" Tony Butler Jul. 7, 2003.
Article from www.surfit.com "World's 1st Stitchless Boardies" 2003.
International Search Report for PCT/US2005/007671.

(Continued)

*Primary Examiner* — Danny Worrell
(74) *Attorney, Agent, or Firm* — Banner & Witcoff, Ltd.

(57) ABSTRACT

An article of swimwear includes a swimsuit body having at least one aperture configured to encircle a portion of a swimmer's body when the swimsuit is worn by a user, and a resilient seal secured about the at least one aperture.

36 Claims, 4 Drawing Sheets

OTHER PUBLICATIONS

Office Action in corresponding European Application No. 05 725 053.2, mailed Aug. 7, 2009.

Office Action issued Nov. 20, 2009 in corresponding Chinese Patent Application No. 200580007094.4, and English translation thereof.

Office Action issued Apr. 30, 2010 in corresponding Chinese Patent Application No. 200580007094.4, and English translation thereof.

Office Action issued Aug. 23, 2011 in corresponding Chinese Patent Application No. 200580007094.4, and English translation thereof.

Office Action issued Feb. 21, 2011 in corresponding Japanese Patent Application No. 2005-065316, and English translation thereof.

Office Action issued May 17, 2011 in corresponding Chinese Patent Application No. 200580007094.4, and English translation thereof.

* cited by examiner

ARTICLE OF SWIMWEAR WITH RESILIENT SEAL

FIELD OF THE INVENTION

This invention relates generally to swimwear, and, in particular, to swimwear with an aperture and a resilient seal about the aperture that provides improved fit and decreased resistance to water flow.

BACKGROUND OF THE INVENTION

A swimmer's performance can be significantly impacted by the configuration of their swimwear. Numerous aspects of conventional swimwear negatively affect the swimmer's range of motion and increase drag, leading to reduced performance.

The leading edges of known swimwear, that is, the edges that are leading when a user is swimming through the water, e.g., the neck opening, armholes, and waistline, can often flair open away from the user's body and scoop water as the swimmer moves through the water. The increased mass from the water scooped into the swimwear can cause a great deal of drag and, therefore, have a significant negative impact on the swimmer's performance. Additionally, these leading edges often are formed by folding over and stitching the material used to form the swimwear, resulting in a relatively thick and hydrodynamically inefficient border of the swimwear that also increases drag.

Known swimwear is typically stretched over the user's body, and may be secured with a closure or fastening device such as a zipper, snap, clasp, etc. Such fastening devices can create various problems for the swimmer. For example, zippers do not stretch, thereby limiting the flexibility of the swimwear. The flexibility of a swimsuit may also be hampered by other aspects of known swimwear, including shoulder straps and armhole openings. The starting positions for swimmers, as well as their arm motions during swimming, are extreme, and require a great deal of flexibility in the swimwear. Thus, any reduction in the flexibility of the swimsuit can reduce the swimmer's range of motion and negatively affect the swimmer's performance. Additionally, snaps, clasps, and other fastening devices create hydrodynamic drag, resulting in reduced performance.

It is an object of the present invention to provide an article of swimwear with a resilient seal about an aperture that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide an article of swimwear with a resilient seal about an aperture through which a portion of a swimmer's body protrudes. Such a seal provides a tight and resilient fit on the user's body.

In accordance with a first aspect, an article of swimwear includes a swimsuit body having at least one aperture configured to encircle a portion of a swimmer's body when the swimsuit is worn by a user, and a resilient seal secured about the at least one aperture.

In accordance with another aspect, an article of swimwear includes a swimsuit body having at least one aperture configured to encircle a portion of a swimmer's body when the swimsuit body is worn by a user and configured to be a leading edge of the swimsuit when the user is swimming. A resilient seal is secured about the at least one aperture.

Substantial advantage is achieved by providing an article of swimwear with a resilient seal about an aperture in the swimwear. In particular, an article of swimwear with a resilient seal provides a tight and resilient fit on the user's body. This is highly advantageous since it reduces the chance of the edge of the swimsuit at that location scooping water, leading to increased performance. Additionally, such a resilient seal allows a tight fit on the user without the use of a closure device, such as a zipper.

These and additional features and advantages of the invention disclosed here will be further understood from the following detailed disclosure of certain preferred embodiments.

Figure 1A:
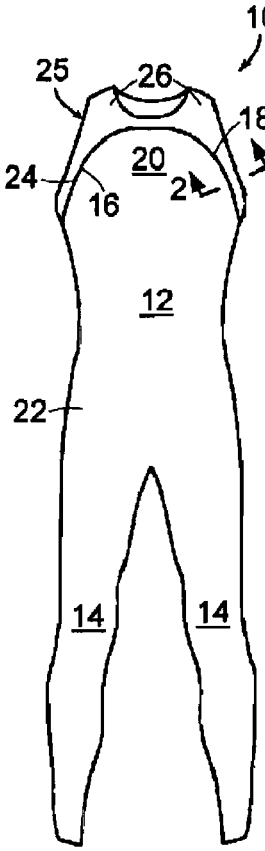
FIGS. 1A-1C are elevation views of a preferred embodiment of an article of swimwear with a seal in accordance with the present invention.

The figures referred to above are not drawn necessarily to scale and should be understood to provide a representation of the invention, illustrative of the principles involved. Some features of the article of swimwear with a resilient seal depicted in the drawings have been enlarged or distorted relative to others to facilitate explanation and understanding. The same reference numbers are used in the drawings for similar or identical components and features shown in various alternative embodiments. Articles of swimwear with a resilient seal as disclosed herein, would have configurations and components determined, in part, by the intended application and environment in which they are used.

DETAILED DESCRIPTION OF CERTAIN PREFERRED EMBODIMENTS

Figure 1B:
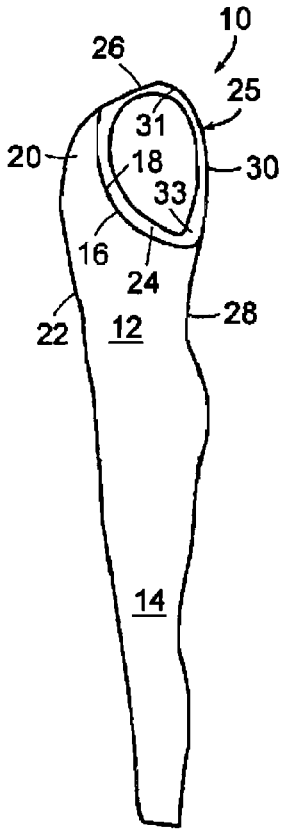
Figure 1C:
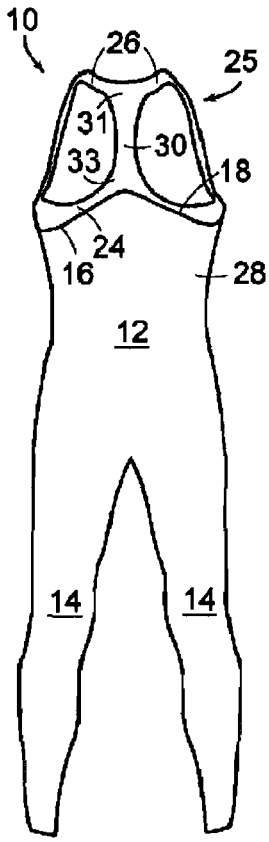

The present invention may be embodied in various forms. A preferred embodiment of an article of swimwear such as swimsuit 10 is shown in FIGS. 1A-1C. Swimsuit 10 is illustrated here as a men's full length swimsuit, often referred to as a full length bodysuit, extending from the upper torso and down the user's legs to a point just above the user's ankles. It is to be appreciated that the size and shape of swimsuit 10 may vary, as described in greater detail below. It is also to be appreciated that swimsuits in accordance with the present invention are suitable for use by both men and women, and that the swimsuit will be constructed to appropriately match the anatomy of the user.

As illustrated in FIGS. 1A-1C, swimsuit 10 has a torso portion 12 and leg portions 14. An upper edge 16 of torso portion 12 defines an aperture 18 that receives the upper torso of a user (not shown). In the illustrated embodiment, an upper central portion 20 of the front 22 of torso portion 12 is elongated with respect to the remainder of torso portion 12, that is, it extends higher on the user's torso. Elongated central portion 20 serves to allow torso portion 12 to cover the user's chest, while allowing upper edge 16 along the sides of torso portion 12 to pass under the user's arms.

Swimsuit 10 may be formed of a blend of LYCRA® (type of spandex) and polyester, a blend of LYCRA® and nylon, or any other suitable material. Preferable materials include those that are stretchable such that the swimsuit can be stretched over the user's body to provide a tight conforming fit. Other suitable materials for swimsuit 10 will become readily apparent to those skilled in the art, given the benefit of this disclosure.

A resilient seal 24 is secured about aperture 18. Seal 24 provides a positive hydrodynamic seal with the user's torso, tightly retaining swimsuit 10 to the user about aperture 18. By providing seal 24 of a resilient material, no additional closure mechanism is required to secure swimsuit 10 to the user's body. The swimmer simply spreads seal 24, steps into swimsuit 10 through aperture 18, and pulls swimsuit 10 up around their body. Seal 24 is sufficiently resilient to stretch wide enough to allow the user's body to fit through aperture 18 and then return to its original size. The problems associated with closure devices such as failure, decreased flexibility of the swimsuit, and increased water resistance can be avoided with the use of resilient seal 24. The increased flexibility provided throughout a swimsuit 10 having a resilient seal 24 is especially advantageous when swimmers are poised to begin a race and their body is coiled and poised to spring out into the water. Additionally, the reduced profile of resilient seal 24 can improve hydrodynamic effects of swimsuit 10 as compared to a hemmed and stitched leading edge.

In a preferred embodiment, seal 24 is made of silicone. Since silicone is dimensionally stable in water, seal 24 will not stretch when wet, thereby ensuring a tight seal on the user's body. Further, the smooth surface of the silicone material increases surface friction on the user's skin, enhancing the stick of seal 24 to the user's skin. Seal 24 may also be formed of an elastomer such as rubber, latex, or urethane, or any other resilient material suitable for wrapping about a portion of a user's body, and which can be secured to swimsuit 10.

Swimsuit 10 may have a harness assembly such as a shoulder strap assembly 25 to help keep swimsuit 10 on the user's body. In a preferred embodiment, shoulder strap assembly 25 is formed of a pair of shoulder straps 26 and a back strap 30. Shoulder straps 26 extend from upper edge 16 of upper central portion 20 over the shoulders of a user to a first end 31 of back strap 30 at an upper portion of the user's back. A second end 33 of back strap 30 is connected to seal 24 at upper edge 16 of a back 28 of swimsuit 10. It is to be appreciated that shoulder straps 26 could each extend directly back to upper edge 16 of back 28 rather than be connected to back strap 30. In a preferred embodiment, shoulder strap assembly 25 and seal 24 are of unitary, that is, one-piece construction.

Figure 2:
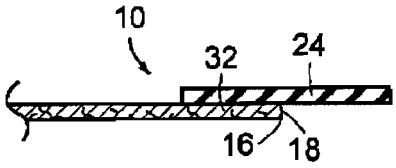
FIG. 2 is a section view, taken along line 2-2 of FIG. 1A, showing a preferred embodiment of the connection of the seal to the article of swimwear of FIGS. 1A-1C.

One manner of securing seal 24 to swimsuit 10 is illustrated in FIG. 2. In this embodiment, seal 24 is secured about aperture 18 of swimsuit 10 by way of a layer of adhesive 32 disposed between seal 24 and swimsuit 10. Suitable adhesives include epoxies and silicone adhesives. Other suitable adhesives will become readily apparent to those skilled in the art, given the benefit of this disclosure. In other preferred embodiments, seal 24 may be secured by heat melting, radio frequency welding or ultrasonic welding.

Figure 3:
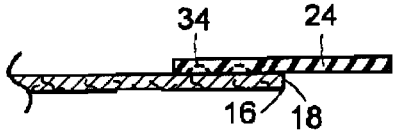
FIG. 3 is a section view of an alternative embodiment of the connection of the seal to the article of swimwear of FIGS. 1A-1C.

Another manner of securing seal 24 to swimsuit 10 is illustrated in FIG. 3. In this embodiment, seal 24 is secured to torso 12 of swimsuit 10 by way of stitching 34. It is to be appreciated that seal 24 may be secured to swimsuit 10 in additional ways, including flatseaming, cover stitching and serging. Other suitable ways of securing seal 24 to swimsuit 10 will become readily apparent to those skilled in the art, given the benefit of this disclosure.

Figure 4A:
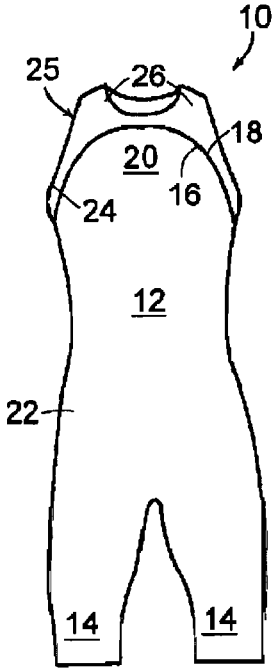
FIGS. 4A-4C are elevation views of an alternative embodiment of the article of swimwear of FIGS. 1A-1C.
Figure 4B:
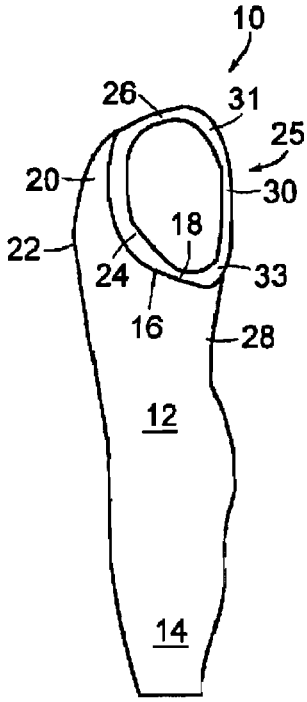
Figure 4C:
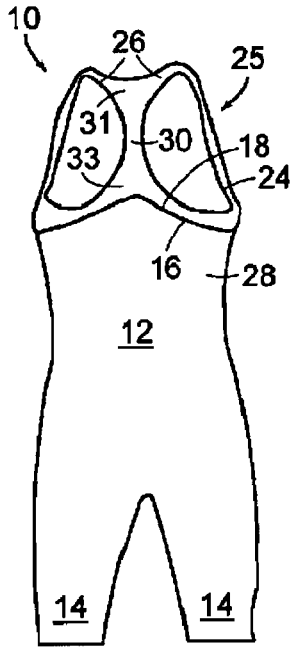

As noted above, FIGS. 1A-1C show swimsuit 10 as a full length bodysuit in which legs extend down the user's legs to a point proximate their ankles. FIGS. 4A-4C show an alternative embodiment in which swimsuit 10 is a knee length body suit, in which legs 14 extend to the thigh of the user, just above their knee.

Figure 5:
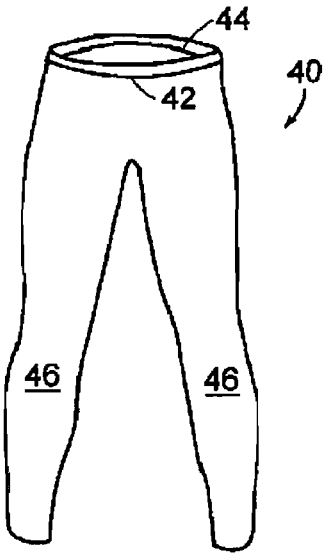
FIG. 5 is a front elevation view of another alternative embodiment of an article of swimwear in accordance with the present invention.
Figure 6:
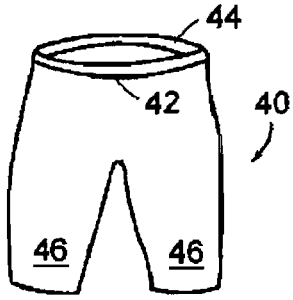
FIG. 6 is a front elevation view of yet another alternative embodiment of an article of swimwear in accordance with the present invention.

Another embodiment of a swimsuit 40 is shown in FIG. 5, which shows a version of a swimsuit having the shape of a pair of pants, commonly referred to as a tight or leggings. Swimsuit 40 has an aperture 42 configured to encircle a user's waist, to which is secured a resilient seal 44. Swimsuit 40 has long legs 46 extending to just above the user's ankles. A similar embodiment is shown in FIG. 6, in which the legs 46 extend to just above the user's knees. Such an embodiment is commonly referred to as swim shorts or a jammer.

Figure 7:
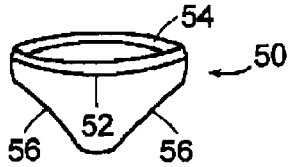
FIG. 7 is a front elevation view of a further alternative embodiment of an article of swimwear in accordance with the present invention.

Another embodiment is shown in FIG. 7, in which swimsuit 50 has no legs, and is commonly referred to as a brief. Swimsuit 50 has an aperture 52 configured to encircle a user's waist, to which is secured a resilient seal 54. Swimsuit has leg apertures 56 through which the user's legs extend.

In each of swimsuits 40 and 50, shown in FIGS. 5-7, the user simply steps into the swimsuit, puts their legs into the legs of the swimsuit or into the leg apertures, and pulls the swimsuit up until its upper edge and seal is positioned about the user' waist. Resilient seals 44, 54 obviate the need for a waistcord or any other type of fastener about the user's waist. This improves the fit of the swimsuit as well as reducing drag, thereby enhancing performance.

Figure 8A:
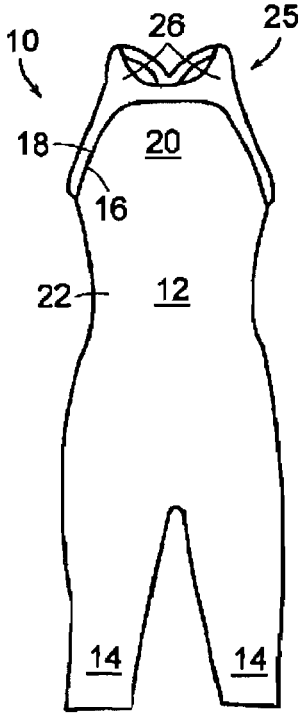
FIGS. 8A-8C are elevation views of an alternative embodiment of the article of swimwear of FIGS. 1A-1C.
Figure 8B:
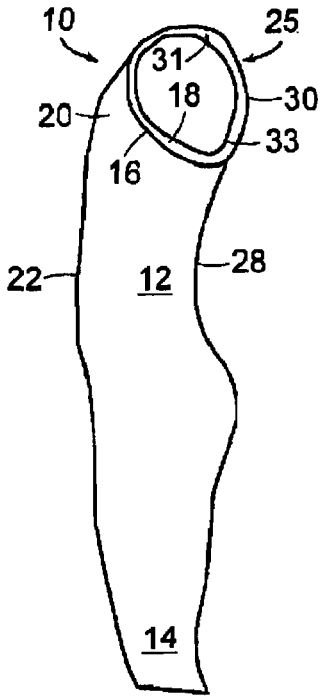
Figure 8C:
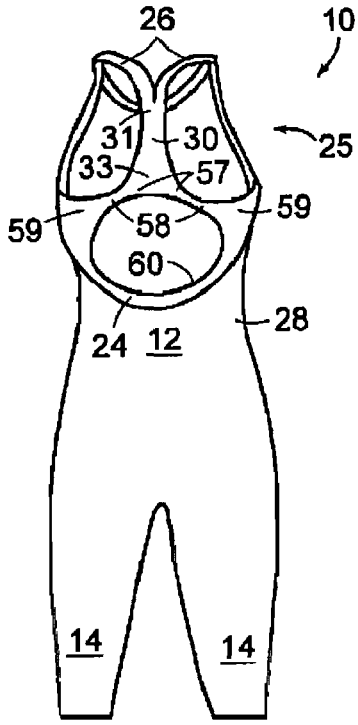

Another embodiment is shown in FIGS. 8A-8C. The embodiment of swimsuit 10 illustrated here is a full length women's body suit that is similar in many respects to the men's full length body suit shown in FIGS. 1A-1C. In this embodiment, second end 33 of back strap 30 is connected to a first end 57 of each one of a pair of transverse straps 58. Opposed second ends 59 of each transverse strap 58 is secured to seal 24 at a side of back 28 of swimsuit 10. Seal 24 and transverse straps 58 define an aperture 60 that exposes a significant portion of the user's back. This embodiment is often referred to as an open back swimsuit, and is favored by many female swimmers. In a preferred embodiment, seal 24, shoulder straps 26, back strap 30 and side straps 58 are formed of unitary construction.

Figure 9A:
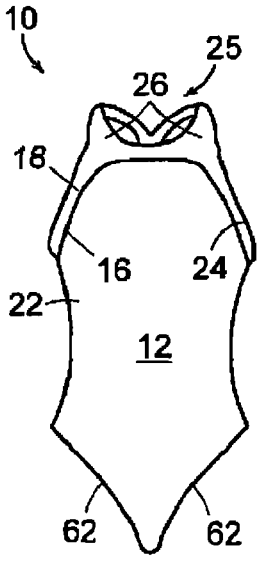
FIGS. 9A-9C are elevation views of an alternative embodiment of the article of swimwear of FIGS. 1A-1C.
Figure 9B:
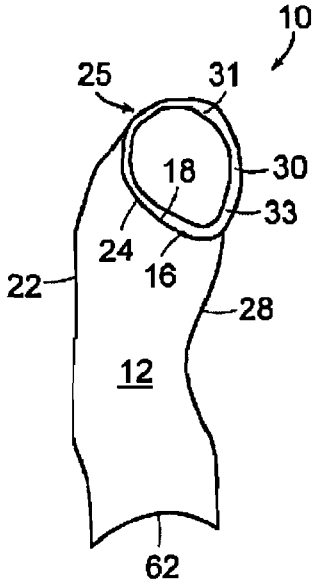
Figure 9C:
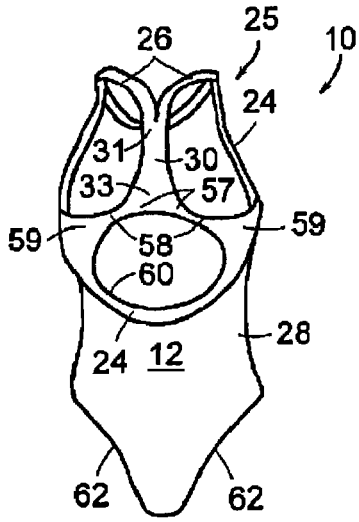

Yet another embodiment is shown in FIGS. 9A-9C. This embodiment is similar to that shown in FIGS. 8A-8C, however, in this embodiment, rather than having legs, swimsuit 10 merely has apertures 62 through which the user's legs protrude. Thus, it can be seen that the leg portions of swimsuits in accordance with the present invent may be of any desired length, and that certain embodiments may not have any leg portions at all.

Figure 10:
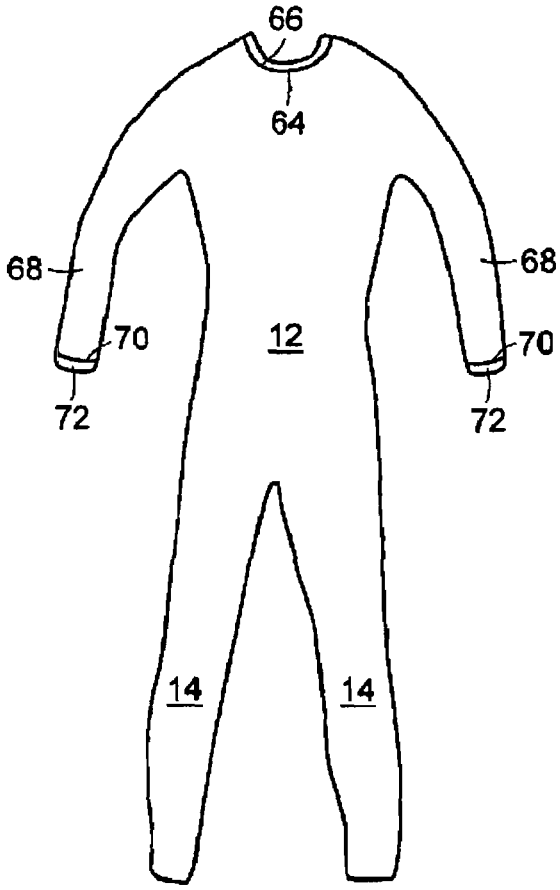
FIG. 10 is a front elevation view of an alternative embodiment of the article of swimwear of FIGS. 1A-1C.

A further embodiment is illustrated in FIG. 10, in which an aperture 64 at an upper edge of torso portion 12 of swimsuit 10 is configured to encircle the user's neck. A seal 66 is secured about aperture 64 as described above. Additionally, in this embodiment, swimsuit 10 includes arms 68 having apertures 70 at their ends proximate a user's wrists. A seal 72 is secured to each aperture 70 as described above. Thus, it can be seen that a seal in accordance with the present invention can be secured about an aperture in a swimsuit in many locations that will present a leading edge when the user is swimming.

Figure 11:
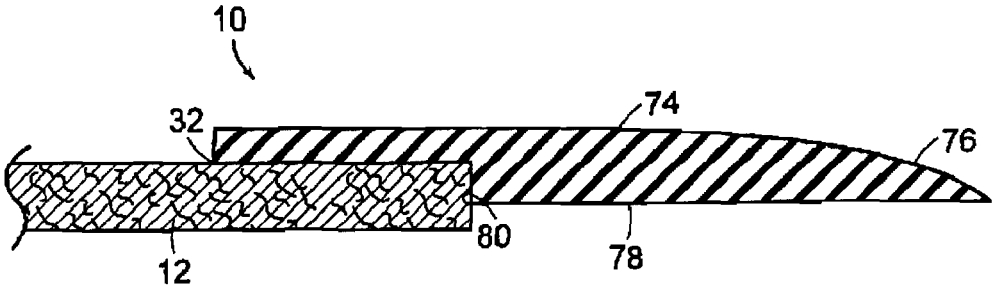
FIG. 11 is a section view, shown partially broken away, of an alternative embodiment of the seal of the article of swimwear of FIGS. 1A-1C.

Another preferred embodiment of a seal 74 is shown in FIG. 11, in which an outermost or leading edge 76 of seal 74 is tapered, providing decreased resistance as the swimmer moves through the water. Additionally, as illustrated here, an interior surface 78 of seal 74 may include a recess 80, which receives an outermost edge of the material of the body of swimsuit 10.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. An article of swimwear comprising, in combination:

a swimsuit body configured to be stretched over a swimmer's body such that the entire swimsuit body provides a conforming fit on a swimmer's body and having at least one aperture configured to encircle a portion of a swimmer's body when the swimsuit body is worn by a user; and a resilient seal comprising:

an interior surface, a first portion of the interior surface secured about the at least one aperture on an exterior of the swimsuit body and a second portion of the interior surface extending beyond the swimsuit body and configured to contact the user's body when the swimsuit body is worn by the user;

an exterior surface that is opposed to the interior surface and is completely exposed to an exterior of the swimsuit body;

a first edge extending from the interior surface to the exterior surface and being a leading edge of the seal when the user is swimming; and a second edge opposed to the first edge and extending from the interior surface to the exterior surface.

2. The article of swimwear of claim 1, wherein the seal is secured to the swimsuit body with an adhesive.

3. The article of swimwear of claim 1, wherein the seal is secured to the swimsuit body with stitching.

4. The article of swimwear of claim 1, wherein the seal is secured to the swimsuit body by welding.

5. The article of swimwear of claim 1, wherein the aperture is configured to encircle the waist of a user.

6. The article of swimwear of claim 1, wherein the aperture is configured to encircle an upper portion of the torso of a user.

7. The article of swimwear of claim 1, wherein the aperture is configured to encircle the arm of a user.

8. The article of swimwear of claim 1, wherein the aperture is configured to encircle the neck of a user.

9. The article of swimwear of claim 1, wherein the seal is formed of an elastomer.

10. The article of swimwear of claim 1, wherein the seal is formed of one of silicone, rubber, latex and urethane.

11. The article of swimwear of claim 1, wherein the swimsuit body is a full length body suit.

12. The article of swimwear of claim 1, wherein the swimsuit body is a tight configured to extend from a user's waist to a point proximate the user's ankles.

13. The article of swimwear of claim 1, wherein the swimsuit body is a pair of shorts.

14. The article of swimwear of claim 1, further comprising a harness assembly, the harness assembly connected to the seal at an upper edge of a front of the swimsuit body and to the seal at an upper edge of a back of the swimsuit body, the harness configured to extend over a user's shoulders.

15. The article of swimwear of claim 14, wherein the harness assembly is of unitary construction with the seal.

16. The article of swimwear of claim 14, wherein the harness assembly includes a pair of shoulder straps and a back strap, each shoulder strap secured at a first end thereof to the seal at the upper edge of the front of the swimsuit body and at a second end thereof to a first end of the back strap, an opposed second end of the back strap secured to the seal at the upper edge of the back of the swimsuit body.

17. The article of swimwear of claim 14, wherein the harness assembly includes a pair of shoulder straps, a back strap, and a pair of transverse straps, each shoulder strap being secured at a first end thereof to the seal at the upper edge of the front of the swimsuit body and at a second end thereof to a first end of the back strap, an opposed second end of the back strap being secured to first ends of each of the transverse straps, opposed second ends of the transverse straps being secured to the seal at opposed sides of the back of the swimsuit body.

18. The article of swimwear of claim 17, wherein the upper edge of the seal at the back of the swimsuit body and the transverse straps define an aperture.

19. The article of swimwear of claim 1, wherein at least a portion of an outer side of the seal is tapered to a peripheral edge of the seal.

20. The article of swimwear of claim 1, wherein an interior surface of the seal includes a recess configured to receive a portion of the swimsuit body.

21. An article of swimwear comprising, in combination:

a swimsuit body configured to be stretched over a swimmer's body such that the entire swimsuit body provides a conforming fit on a swimmer's body and having at least one aperture configured to encircle a portion of a swimmer's body when the swimsuit body is worn by a user and configured to be a leading edge of the swimsuit when the user is swimming; and a resilient seal comprising:

an interior surface, a first portion of the interior surface secured about the at least one aperture on an exterior of the swimsuit body and a second portion of the interior surface extending beyond the swimsuit body and configured to contact the user's body when the swimsuit body is worn by the user;

an exterior surface that is opposed to the interior surface and is completely exposed to an exterior of the swimsuit body;

a first edge extending from the interior surface to the exterior surface and being a leading edge of the seal when the user is swimming; and a second edge opposed to the first edge and extending from the interior surface to the exterior surface.

22. The article of swimwear of claim 21, wherein the seal is secured to the swimsuit body with an adhesive.

23. The article of swimwear of claim 21, wherein the seal is secured to the swimsuit body with stitching.

24. The article of swimwear of claim 21, wherein the aperture is configured to encircle the waist of a user.

25. The article of swimwear of claim 21, wherein the aperture is configured to encircle an upper portion of the torso of a user.

26. The article of swimwear of claim 21, wherein the aperture is configured to encircle the arm of a user.

27. The article of swimwear of claim 21, wherein the aperture is configured to encircle the neck of a user.

28. The article of swimwear of claim 21, wherein the seal is formed of one of silicone, rubber, and latex.

29. The article of swimwear of claim 21, wherein the swimsuit body is a full length body suit.

30. The article of swimwear of claim 21, wherein the swimsuit body is a tight configured to extend from a user's waist to a point proximate the user's ankles.

31. The article of swimwear of claim 21, wherein the swimsuit body is a pair of shorts.

32. The article of swimwear of claim 21, further comprising a harness assembly, the harness assembly connected to the seal at an upper edge of a front of the swimsuit body and to the seal at an upper edge of a back of the swimsuit body, the harness configured to extend over a user's shoulders.

33. The article of swimwear of claim 32, wherein the harness assembly is of unitary construction with the seal.

34. The article of swimwear of claim 32, wherein the harness assembly includes a pair of shoulder straps and a back strap, each shoulder strap secured at a first end thereof to the seal at the upper edge of the front of the swimsuit body and at a second end thereof to a first end of the back strap, an opposed second end of the back strap secured to the seal at the upper edge of the back of the swimsuit body.

35. The article of swimwear of claim 32, wherein the harness assembly includes a pair of shoulder straps, a back strap, and a pair of transverse straps, each shoulder strap being secured at a first end thereof to the seal at the upper edge of the front of the swimsuit body and at a second end thereof to a first end of the back strap, an opposed second end of the back strap being secured to first ends of each of the transverse straps, opposed second ends of the transverse straps being secured to the seal at opposed sides of the back of the swimsuit body.

36. The article of swimwear of claim 35, wherein the upper edge of the seal at the back of the swimsuit body and the transverse straps define an aperture.

* * * * *